US006003962A

United States Patent [19]

Song

[11] Patent Number: 6,003,962

[45] Date of Patent: Dec. 21, 1999

[54] HEIGHT-CONTROLLABLE DESK

[76] Inventor: Sang Goo Song, 203-605, Joogong Apt., 4 Block 1 Lot, Pulri Hyang Chon, Pulri Dong,Sachun, Kyungsangnam Do, Rep. of Korea

[21] Appl. No.: 09/148,177

[22] Filed: Sep. 4, 1998

[30] Foreign Application Priority Data

Dec. 8, 1997 [KR] Rep. of Korea ..... 97-36028

[51] Int. Cl.[6] ..... A47B 17/02

[52] U.S. Cl. ..... 312/195; 312/194; 248/188.5

[58] Field of Search ..... 312/194, 195, 312/196, 223.3, 350, 351, 239, 277, 281, 317.1, 351.4, 205; 108/110, 147.16, 147.17, 147.21, 147.19; 248/188.2, 188.5

[56] References Cited

U.S. PATENT DOCUMENTS

| | | | |
|---|---|---|---|
| 887,560 | 5/1908 | White | 108/147.21 X |
| 2,777,247 | 1/1957 | Rosenberg | 248/188.5 |
| 2,831,739 | 4/1958 | Fryckholm | 248/188.5 |
| 3,790,241 | 2/1974 | Messina | 312/195 X |
| 4,762,072 | 8/1988 | Boundy et al. | 312/194 X |
| 5,020,867 | 6/1991 | McManus | 312/239 X |

FOREIGN PATENT DOCUMENTS

| | | | |
|---|---|---|---|
| 2290868 | 6/1976 | France | 312/205 |
| 871056 | 3/1953 | Germany | 312/194 |
| 50-15535 | 5/1975 | Japan . | |
| 50-42001 | 11/1975 | Japan . | |
| 51-2003 | 1/1976 | Japan . | |
| 51-3763 | 2/1976 | Japan . | |
| 54-40241 | 11/1979 | Japan . | |
| 2143429 | 2/1985 | United Kingdom | 312/194 |

OTHER PUBLICATIONS

Ikea Catalog, pp. 234–235, Dec. 1996.

*Primary Examiner*—Peter R. Brown
*Assistant Examiner*—James O. Hansen
*Attorney, Agent, or Firm*—Jacobson & Johnson

[57] ABSTRACT

A height controllable desk having a top plate having a first end and a second end with a first desk support and a second desk support having a first plurality of vertically spaced members thereon for providing vertically positionable support to the second end of the top plate and a U-shaped connecting cover having a plurality of vertically spaced members securable at different vertical locations to the first desk support to provide support for the first end of the top plate whereby the top plate can be adjusted to the proper vertical height on both ends thereof.

5 Claims, 4 Drawing Sheets

HEIGHT-CONTROLLABLE DESK

FIELD OF THE INVENTION

The present invention generally relates to a desk, and more specifically, to a height-controllable desk that can be adjusted to fit the user.

BACKGROUND OF THE INVENTION

A conventional desk is supported by integral end members and is generally not adjustable to the height of the user. The present invention provides a desk wherein the height of the top plate can be adjusted to accommodate the user without upsetting the appearance of the desk.

SUMMARY OF THE INVENTION

Briefly, the present invention comprises a height controllable desk having a top plate having a first end and a second end and a first desk support and a second desk support having a first plurality of vertically spaced members thereon with the first vertically spaced members providing vertically positionable support to the second end of the top plate, and a connecting cover having a second plurality of vertically spaced members, with the connecting cover having a general U-shape that is securable to the top plate and vertically positionable and securable at different vertical locations on the first desk support to provide support for the first end of the top plate so that both ends of the top plate can be adjusted to the proper vertical height.

BRIEF DESCRIPTION OF THE DRAWINGS

FIG. 4 (*b*) is a partial cross-sectional view of other end of the desk of FIG. 1 with respect to FIG. 4(*a*).

DESCRIPTION OF THE PREFERRED EMBODIMENT

Figure 1:
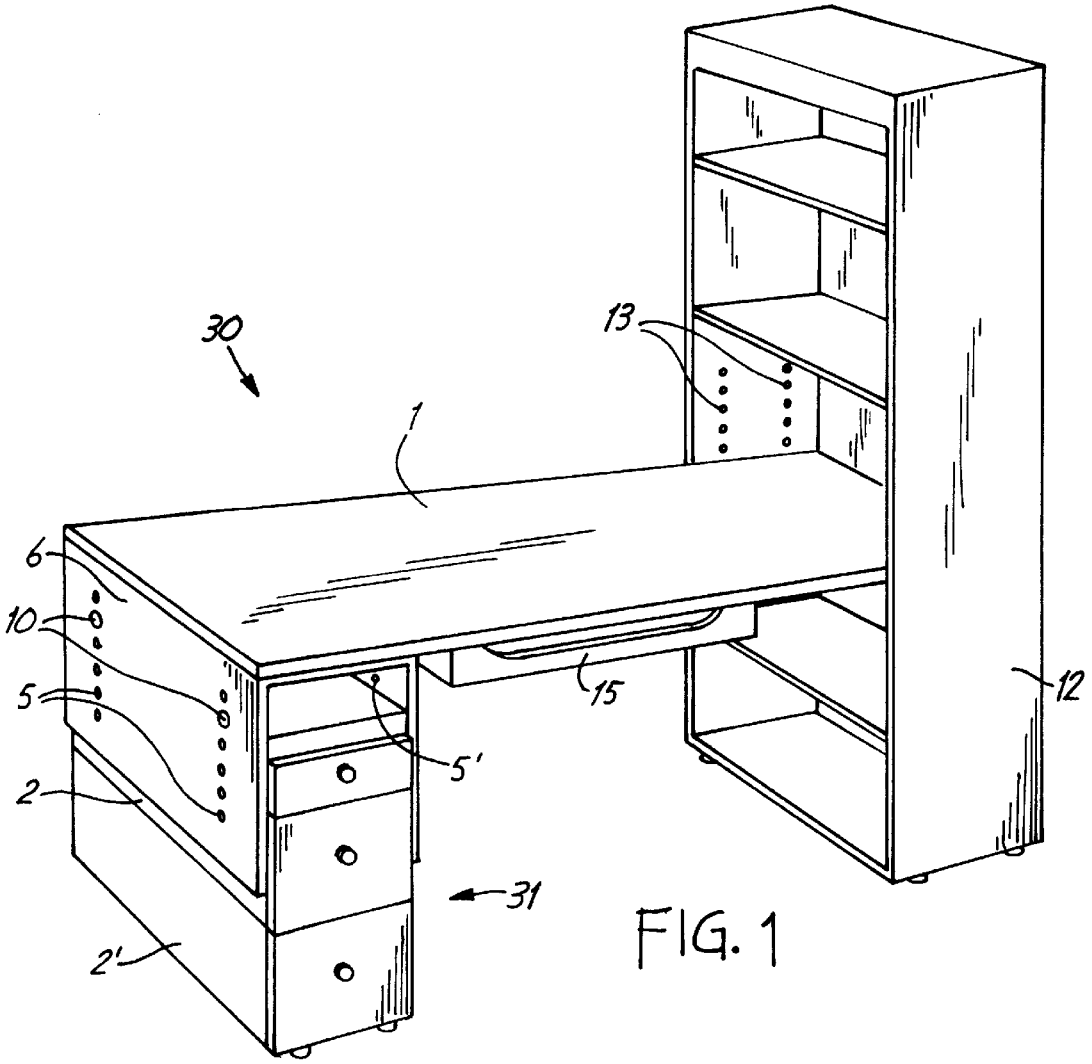
FIG. 1 shows a perspective view of a height controllable desk made according to the present invention.

Referring to FIG. 1 reference numeral 30 generally identifies my height controllable desk that includes a detachable drawer cabinet having an upper drawer cabinet 2 and a lower drawer cabinet 2' which coact to form a first desk support 31. Located on top of first desk support 31 is a U-shaped connecting cover 6. A top plate 1 extends from the first desk support 31 to a second desk support 12, which comprises a bookcase. Top plate 1 acts as the desk surface work area. Connecting cover 6 contains a set of vertically spaced holes 5 having supporting sidewalls therein with a member 10 extending therethrough to support the connecting cover 6 on the first desk support 31.

On the opposite end of top plate 1, a set of vertically spaced blind holes 13 having supporting sidewall with the blind holes extending vertically along the bookcase sidewall to provide for placement of vertically spaceable members or dowel pin supports for the opposite end of top plate 1.

Figure 2:
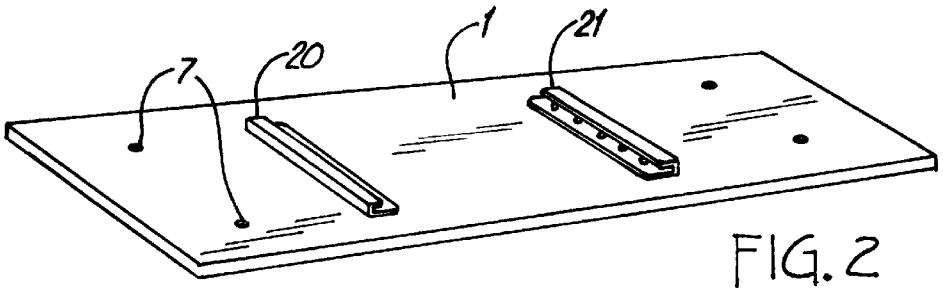
FIG. 2 is a perspective view of the underside of the top plate of the desk of FIG. 1.

FIG. 2 shows the underside of top plate including a set of blind holes 7 for receiving dowel pins 8 (see FIG. 3) for engaging the top plate with the connecting cover 6. The underside of top plate also carries a first rail 20 and a second rail 21 to permit a drawer 15 (FIG. 1) to be slid in and out.

Figure 3:
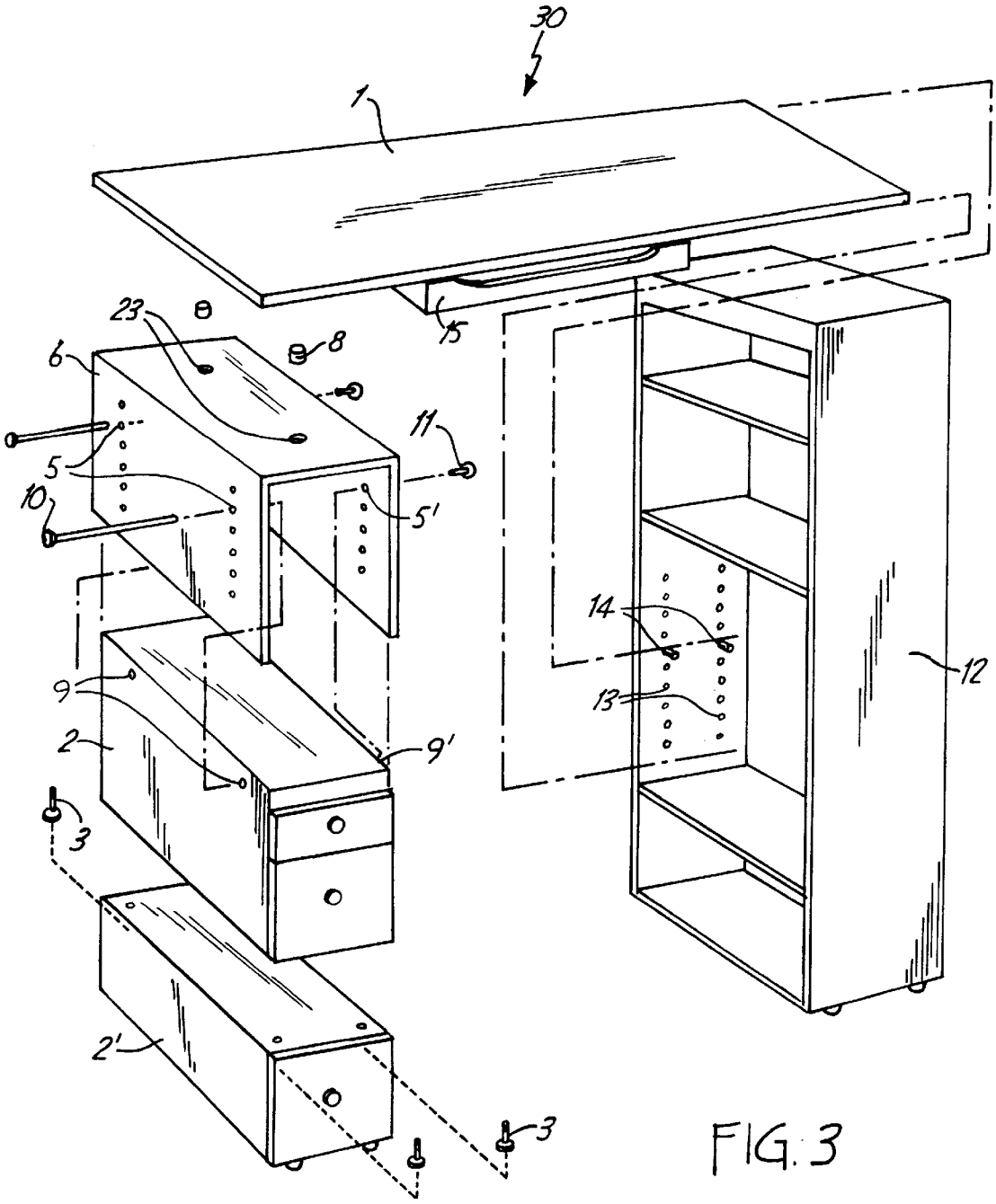
FIG. 3 shows a an exploded view the desk of FIG. 1.

FIG. 3 provides an exploded view of the height controllable desk 30 showing elongated bolts 10 that extend through holes 5 in one side of connecting cover 6, holes 9 in top drawer cabinet 2 and holes 5' in the other side of connecting cover 6. A threaded member 11 engages the end of bolt 10 to secure the connecting cover 6 to the top drawer cabinet 2. As there are a plurality of vertically spaced holes in connecting cover 6, one will be able to position the connecting cover 6 at various heights above the upper drawer cabinet 2 by selecting the holes in the connecting cover and placing the vertically spaceable members or bolts 10 therein at the desired height.

Figure 5:
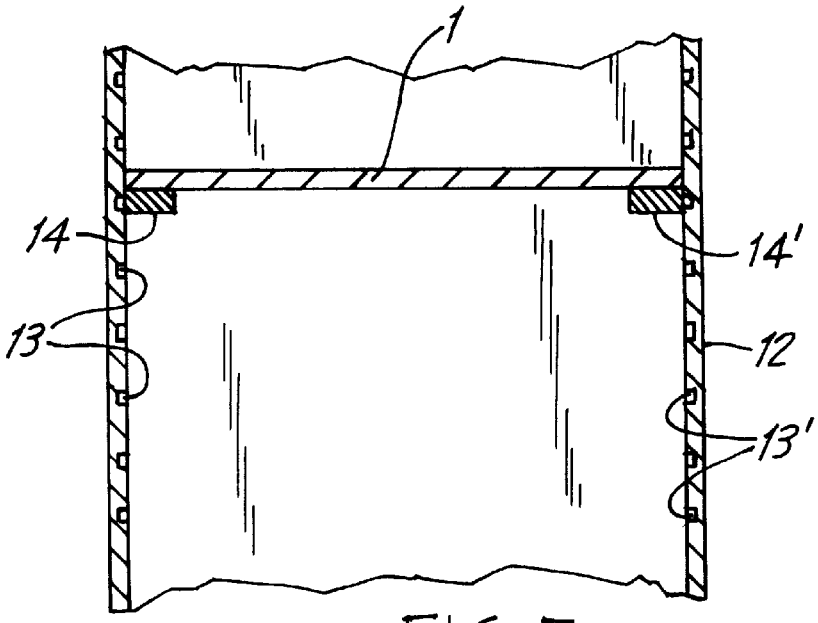
FIG. 5 shows a partial cross-sectional view of the bookcase of FIG. 1.

FIG. 5 shows the opposite end of top plate 1 which is supported by a first dowel pin 14 that extend from one sidewall of bookcase 12 and a second dowel pin 14' that extends from the opposite sidewall of bookcase 12. A set of vertically spaced blind holes 13 having supporting sidewalls are located on one bookcase sidewall and similarly a set of vertically spaced blind holes 13' having supporting sidewalls are located on the opposite bookcase sidewall to provide support for the vertically spaceable dowel pins so that a person can vertically position the dowel pins to support the end of the desk at the proper height. The dowel pins and the supporting sidewalls of the blind holes form fractional engagement so that the dowel pins remain in position during normal use, but can be removed for resetting the height of the desk.

Figure 6:
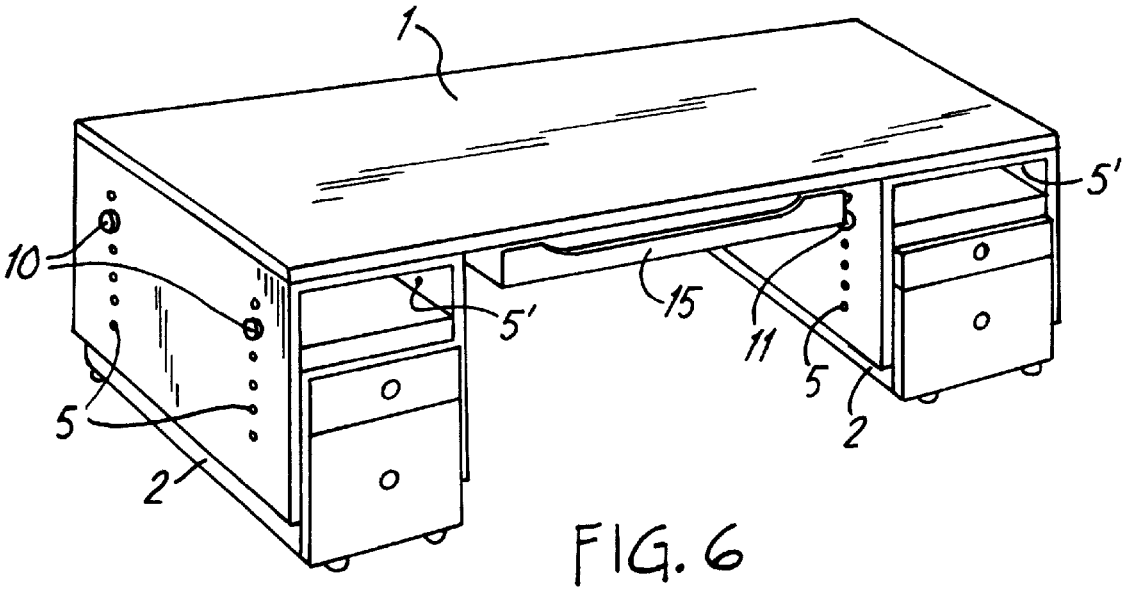
FIG. 6 shows a perspective view of another embodiment of the invention.

FIG. 6 shows a perspective view of an alternate embodiment of the invention wherein a first connecting cover 6 attaches to the first desk support formed by a first set of drawer cabinets and a second connecting cover 6' attaches to a second set of drawer cabinets to provide adjustable support for both ends of desk plate 1. In this embodiment, one creates storage space on top of the drawer cabinets by raising or lowering the connecting covers with respect to the drawer cabinets.

Figure 4A:
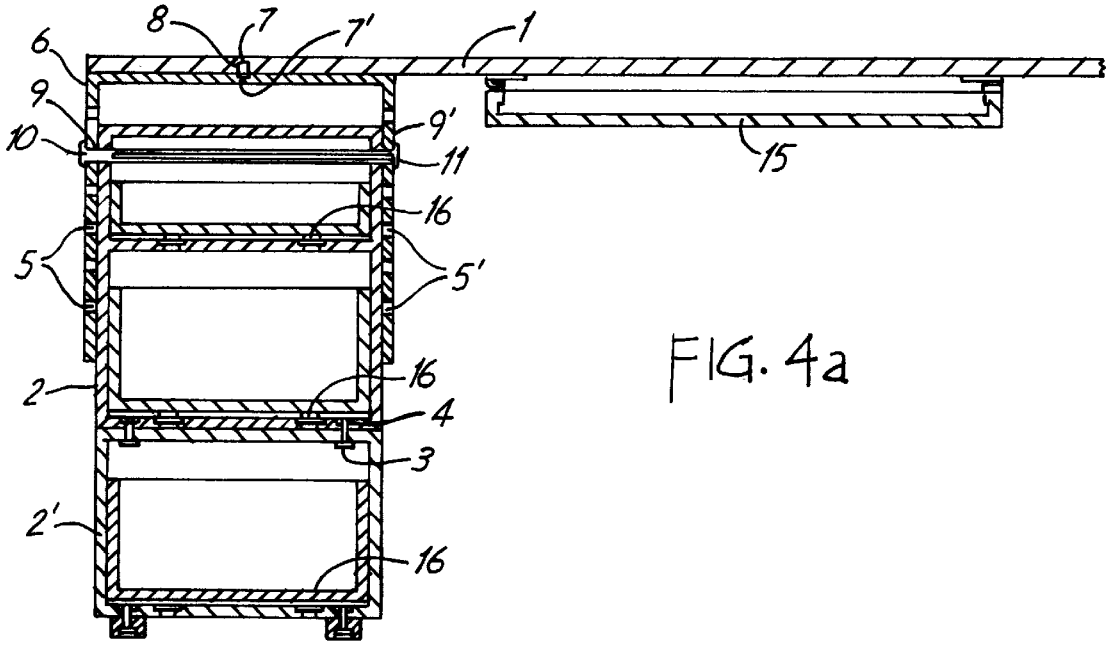
FIG. 4 (*a*) is a partial cross-sectional view of one end of the desk of FIG. 1.
Figure 4B:
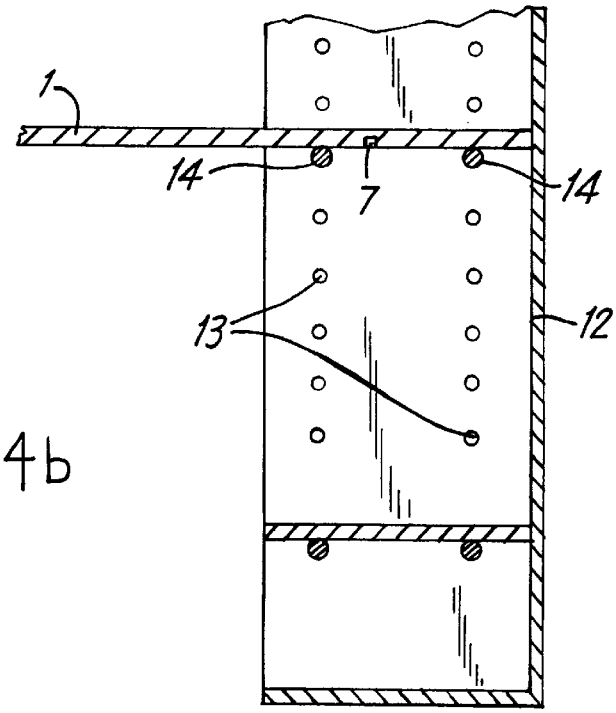

FIG. 4 (*a*) shows the desk support in a cross-sectional view revealing that the lower drawer cabinet 2' is engaged with the upper drawer cabinet 2 through bolts 3 and nuts 4 to thereby hold the drawer cabinets 2 and 2' as a unitary desk support.

FIG. 4 (*b*) shows one side of top plate is supported by a pair of dowel pins 14 with the dowel pins frictionally engaged with supporting sidewalls in blind holes 13 to allow a person to raise or lower dowel pins 14 to provide for control of the height of the desk. Similarly, (not shown) the opposite side of the top plate is supported by a pair of dowel pins 14', one of which is shown in FIG. 5.

Thus, with the desk according to the present invention as shown in FIG. 1, one can adjust the height of one end of the top plate to the desired height by placing the dowel pins 14 and 14' in engagement with the supporting sidewalls of the blind holes of the bookcase. By having a frictional engagement between the blind holes and the dowel pins, the dowel pins will remain in position when in use and can be removed by hand pressure if the height of the desk needs to be changed. The other end of the top plate can be adjusted by positioning the rods 10 in the proper holes 5 in the connecting cover 6.

I claim:

1. A height controllable desk comprising:

a top plate having a first end and a second end;

a first desk support;

a second desk support;

a first U-shaped connecting cover, said first U-shaped connecting cover securable to said top plate, said first U-shaped connecting cover having a set of vertically spaced members with said first U-shaped connecting cover securable at different vertical locations on said first desk support to provide support for said first end of said top plate whereby said top plate can be adjusted to the proper vertical height; and a second U-shaped connecting cover, said second U-shaped connecting cover securable to said top plate, said second U-shaped connecting cover having a set of vertically spaced members with said second U-shaped connecting cover securable at different vertical locations on said second desk support to provide support for said second end of said top plate whereby said top plate can be adjusted to the proper vertical height wherein the first desk support includes a drawer cabinet, with the first desk support and the first U-shaped connecting cover forming a storage space therebetween.

2. The height controllable desk of claim 1 wherein the second desk support includes a drawer cabinet.

3. The height controllable desk of claim 1 wherein the first U-shaped connecting cover is pinned to said top plate with dowel pins.

4. The height controllable desk of claim 1 wherein the first U-shaped connecting cover engages said first desk support on opposite sides of said first desk support.

5. The height controllable desk of claim 1 including bolts for securing said first U-shaped connecting cover to said first desk support.

* * * * *